US005085045A

United States Patent [19]

Takeuchi et al.

[11] Patent Number: 5,085,045

[45] Date of Patent: Feb. 4, 1992

[54] DOUBLE TWIST SPINDLE APPARATUS

[75] Inventors: Yukio Takeuchi, Kanazu; Akio Nakahashi, Matto; Shingo Kubota, Kanazawa, all of Japan

[73] Assignee: Kabushiki Kaisha Ishikawa Seisakusho Ltd., Kanazawa, Japan

[21] Appl. No.: 533,758

[22] Filed: Jun. 6, 1990

[51] Int. Cl.[5] ..... D01H 7/86

[52] U.S. Cl. ..... 57/58.65; 57/58.76; 57/58.81

[58] Field of Search ..... 57/58.49, 58.65, 58.67, 57/58.68, 58.72, 58.76, 58.81, 58.52

[56] References Cited

U.S. PATENT DOCUMENTS

| | | | |
|---|---|---|---|
| 1,031,366 | 7/1912 | Norman | 57/58.68 |
| 2,611,229 | 7/1952 | Gannon et al. | 57/58.65 |
| 2,654,210 | 10/1953 | Bogdannffy et al. | 57/58.68 |
| 2,873,570 | 2/1959 | Sage | 57/58.72 |
| 3,368,336 | 2/1968 | Franzen | 57/58.67 |
| 3,377,790 | 4/1968 | Brockel | 57/58.67 |
| 3,406,511 | 10/1968 | Nimtz et al. | 57/58.65 |
| 3,530,658 | 9/1970 | Johnson | 57/58.67 |
| 4,063,408 | 12/1977 | Inohara et al. | 57/58.54 |
| 4,165,599 | 8/1979 | Lenorák | 57/58.83 |

FOREIGN PATENT DOCUMENTS

| | | | |
|---|---|---|---|
| 563746 | 11/1932 | Fed. Rep. of Germany | 57/58.76 |
| 2005223 | 9/1970 | Fed. Rep. of Germany | 57/58.49 |
| 57-42931 | 3/1982 | Japan . | |

*Primary Examiner*—Daniel P. Stodola
*Assistant Examiner*—Michael R. Mansen
*Attorney, Agent, or Firm*—Burns, Doane, Swecker & Mathis

[57] ABSTRACT

A double twist spindle apparatus is arranged to wind two lines of first-twisted component yarns after arranging them in order and performing second twisting operation. A take-up bobbin which winds the first-twisted component yarns is rotated by skin frictional drive of a driving roller wherein a yarn winding speed is kept constant even if winding diameter is increased. A hollow spindle and a driving roller are independently driven by separate driving sources. Accordingly, the relation between rotating speed of the hollow spindle and winding speed of the take-up bobbin can be simply changed by regulating the rotational ratio of the two driving sources.

1 Claim, 5 Drawing Sheets

DOUBLE TWIST SPINDLE APPARATUS

BACKGROUND OF THE INVENTION

The present invention relates to a double twist spindle apparatus which is arranged to wind yarns after two lines of first-twisted component yarns are drawn and arranged together, and second twisting operation is performed.

As yarn twisting machines for the manufacture of synthetic fiber for industrial use such as tire cord, there are disclosed well-known double twist spindle apparatuses in U.S. Pat. No. 4,063,408 and Japanese Published Unexamined Patent Application No.42931/1982. An example of conventional double twist spindle apparatus is fundamentally illustrated in FIG. 8.

In the FIG. 8, reference numeral 71 represents a hollow spindle rotatably supported by a bolster 72. The hollow spindle 71 is provided with a yarn inserting hole 74 and a rotating disc 75. The rotation of a spindle driving motor 73 is transmitted to the hollow spindle 71 through pulley 76, belt 77 and pulley 78, while the rotation of the hollow spindle 71 is transmitted to a first pulley 82 which is provided with a permanent magnet 81 through pulley 79 and belt 80.

Reference numeral 83 represents a stationary member supported by the hollow spindle 71 and is kept under non-rotating state. On a bobbin supporting shaft 84 of the stationary member 83, a bobbin holder 85 is rotatably supported. On the bobbin holder 85, a take-up bobbin 86 is fitted and fixed. The bobbin holder 85 is provided with pulleys 87 and 88.

The stationary member 83 has a pulley supporting shaft 89 on which the first pulley 82 is rotatably supported and a second pulley 91 provided with a magnetic plate 90 is also rotatably and movably supported in the axial direction. The permanent magnet 81 and the magnetic plate 90 stand face to face each other with gap S therebetween. Since the magnetic plate 90 is attracted by the permanent magnet 81, when the first pulley 82 is rotated, the second pulley 91 also rotates. When the gap S is small, the driving force to be transmitted from the first pulley 82 to the second pulley 91 is large, while when the gap S is large, the driving force becomes small. The rotation of the second pulley 91 is transmitted to the bobbin holder 85 through a belt 92 and the pulley 87, whereby the take-up bobbin 86 is rotated.

The stationary member 83 is provided with a cam supporting shaft 93 on which a traverse cam shaft 94 is rotatably supported. When the traverse cam shaft 94 is rotated, a traverse guide 95 performs straight reciprocating motion. The rotation of the bobbin holder 85 is transmitted to the traverse cam shaft 94 through the pulley 88, a belt 96 and a pulley 97.

Two lines of the first-twisted component yarns Y are guided into the hole 74 of the hollow spindle 71 and wound around the take-up bobbin 86 guided by the rotating disc 75, traverse guide 95 and the like as shown in the FIG. 8. At this stage, the two lines of yarns Y are arranged together and second twisting operation is performed with the rotation of the hollow spindle 71.

As the lines of yarns Y are wound around the take-up bobbin 86, winding diameter of the take-up bobbin 86 is increased. For instance, when the number of revolutions of the take-up bobbin 86 is constant, winding speed of the lines of yarns Y is increased as the winding diameter increases. It is inconvenient that the winding speed changes. Arrangement is, therefore, made to change the number of revolutions of the second pulley 91 relative to the number of revolutions of the first pulley 81 as previously described. It is also desired to regulate the number of revolutions of the second pulley 91 so as to make the winding speed constant.

The double twist spindle apparatus shown in the FIG. 8 is provided with a sensor 98 for detecting winding diameter of the take-up bobbin 86 and a gap regulating means 99 for changing the gap S by changing the position of the second pulley 91 in the axial direction corresponding to the winding diameter. By regulating the gap S, magnetic attracting force between the permanent magnet 81 and the magnetic plate 90 is regulated, and transmission torque which is transmitted from the first pulley 82 to the second pulley 91 can be regulated. Consequently, it becomes theoretically possible for the take-up bobbin 86 to wind the lines of yarns Y with a constant winding speed under a constant tension.

However, there are the following two problems in the prior art described above. The first problem will now be described.

In order to wind the lines of yarns Y around the take-up bobbin 86 with a constant speed, it is required to decrease the number of revolutions of the take-up bobbin 86 as winding diameter increases and it necessitates to decrease the transmission of driving torque by enlarging the gap S. On the other hand, since the self-weight of the take-up bobbin 86 is increased as winding diameter increases, it is required to increase the transmission of the driving torque in order to wind the lines of yarns Y with a constant tension by rotating the take-up bobbin 86 whose self-weight is increased, and it eventually necessitates to reduce the gap S.

As described above, it is required to enlarge the gap S for keeping winding speed constant as winding diameter of the take-up bobbin 86 increases, while it is required to reduce the gap S for keeping winding tension constant. It is very difficult to regulate the gap S in order to satisfy the above described requirements which are contrary to each other. Moreover, since the magnetic transmission torque between the first pulley 82 and the second pulley 91 changes in quadric relative to the change of the gap S, it becomes more difficult to regulate the gap S.

In the prior art, it is difficult to keep the winding speed and the winding tension of the take-up bobbin 86 constant since the regulation of the gap S can not be made well. Practically, in the conventional apparatus, the winding tension is increased as the winding diameter increases, and it causes to break the lines of yarns Y or produces irregularity in twisting.

The second problem is as follows. As shown in the FIG. 8, the conventional apparatus is arranged to rotate the hollow spindle 71 and the bobbin holder 85 by a single driving source (spindle driving motor 73). Accordingly, it is impracticable to freely and readily change the rotational velocity ratio between the hollow spindle 71 and the bobbin holder 85. Consequently, there remains a problem that changes in the number of twist, winding speed, winding tension and the like can not be performed simply.

SUMMARY OF THE INVENTION

An object of the present invention is to solve the two problems described above.

In order to accomplish the object, the double twist spindle apparatus of the present invention comprises the following means (refer to FIGS. 1 through 7).

a hollow spindle 1 rotatably supported by a bolster 3 fixed to the main frame of machine 4, a bowl-shaped rotating disc 1*b* unitarily arranged in the hollow spindle 1, a stationary member 12 supported at an end portion of the hollow spindle 1 and being kept under non-rotating state, hollow tubular portion 14*b* unitarily arranged with the stationary member 12 at a coaxial position with the hollow spindle 1 in series, a bobbin holder 39 positioned at outer periphery of the hollow tubular portion 14*b* and being rotatably supported on the hollow tubular portion 14*b*, a take-up bobbin 42 fitted on the bobbin holder 39 and supported thereat, a driving roller 27 supported by the stationary member 12, pressing mechanism 29,30,31 which always bring the driving roller 27 in contact with outer periphery of the take-up bobbin 42, a traverse guide 33 supported by the stationary member 12 and performs straight reciprocating motion in the direction parallel to the take-up bobbin 42, yarn inserting holes 1*a*,55 arranged in the hollow spindle 1 and hollow tubular portion 14*b*, yarn guiding means 43,23,22 for guiding two lines of yarns to the yarn inserting holes 1*a*,55 and traverse guide 33, first driving force inputting means 2*a*,2 for rotatively driving the hollow spindle 1 directly, second driving force inputting means 9,8 for rotatively driving the driving roller 27, and transmission means 6,10,17,18,20,19,24,26,28 for transmitting driving force of the second driving force inputting means 9,8 to the driving roller 27.

With the construction arranged as described above, the present invention can perform the following function and effect.

The take-up bobbin is passively rotated by skin frictional drive of the driving roller. Since the rotating speed of the driving roller is constant, the speed on the surface of yarn winding layer is always kept constant. The driving torque inputted from the second driving force inputting means is transmitted to the driving roller through the transmission means, and the driving torque inputted from the second driving force inputting means can effectively be transmitted to the driving roller since it is not necessary to provide a part where driving torque is decreased as in the conventional apparatus.

Accordingly, even if the winding diameter of the take-up bobbin is increased with the progress of winding operation, the winding speed can always be kept constant, and at the same, the driving torque of the driving roller can be maintained at sufficient value. Furthermore, winding tension is kept constant since winding speed and feeding speed of the lines of yarns is are always kept constant. Breakage and irregularity of yarns can thus be avoided.

Moreover, according to the present invention, the hollow spindle is driven by the first driving force inputting means, while the driving roller is separately driven by the second driving force inputting means. Accordingly, the relation between the rotating speed of the hollow spindle and the yarn winding speed of the take-up bobbin can be freely and readily changed by regulating the rotational speed ratio between the first driving force inputting means and the second driving force inputting means. Changes in the number of twist, winding speed, winding tension and the like can, therefore, be carried out simply.

These and other objects and features of the present invention will become more apparent from the following description taken in conjunction with the preferred embodiment thereof with reference to the accompanying drawings.

DESCRIPTION OF THE PREFERRED EMBODIMENTS

Referring to the accompanying drawings, description will be made on a double twist spindle which is provided with take-up means embodying the present invention.

Figure 1:
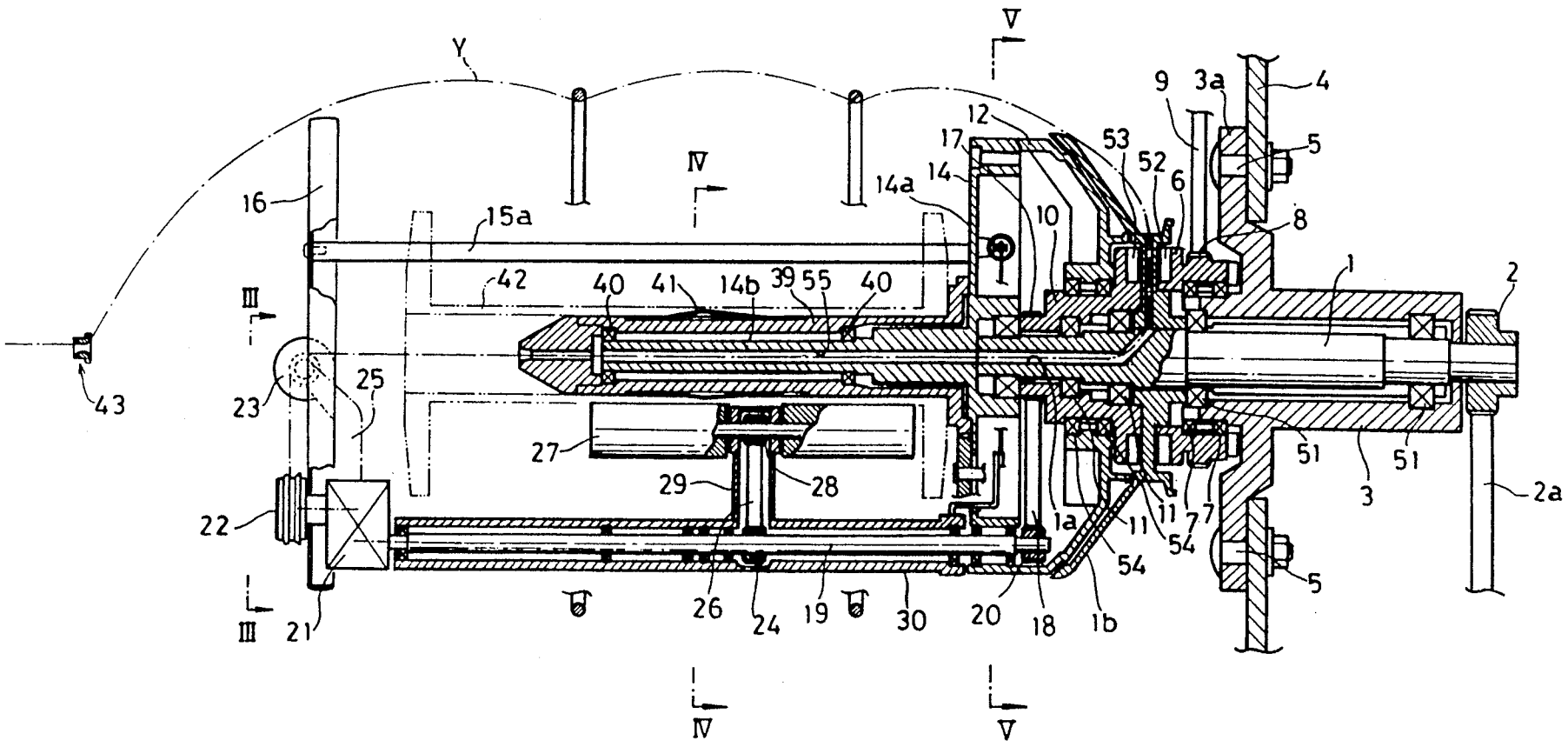
FIG. 1 is a sectional view of a double twist spindle apparatus in an embodiment of the present invention.

In the FIG. 1, reference numeral 1 represents a hollow spindle and on the left half side portion of the spindle, there is provided a hole la for inserting yarns and a rotating disc lb is arranged on the middle outer periphery thereof. At the end of right half side portion on the outer periphery of the spindle 1, a timing pulley 2 is arranged. The hollow spindle 1 is rotatably supported in a bolster 3 through bearings 51,51. Reference numeral 2*a* represents a timing belt which is driven by an unillustrated motor to rotate the timing pulley 2 thereby rotating the hollow spindle 1. Flange portion 3*a* of the bolster 3 is fixed by bolts 5 so as to position the bolster 3 in the horizontal direction. Reference numeral 6 represents a driver wheel provided with a permanent magnet 52. The driver wheel 6 is rotatably supported through bearings 7,7 on the outer periphery of the bolster 3 between the rotating disc 1*b* and the flange portion 3*a* of the bolster 3. Reference numeral 8 represents a timing pulley fixed on the outer periphery of the driver wheel 6, and the pulley 8 is arranged to engage with a timing belt 9 which is driven by a driving source (not illustrated) through proper conductive means. Reference numeral 10 represents a driven wheel substantially in cylindrical shape provided with a permanent magnet 53 to form a pair with the driver wheel 6. The driven wheel 10 is rotatably supported inside the rotating disc 1*b* on the left half side on the outer periphery of the hollow spindle 1 through bearings 11,11. The driven wheel 10 and the driver wheel 6 rotatably stand opposite to each other with the rotating disc therebetween having proper gap. Reference numeral 12 represents a stationary member mounted on the outer periphery of the driven wheel 10 through bearings 54,54 and is arranged face to face inside the rotating disc 1*b*. The stationary member 12 is kept at rest by its self-weight and a heavy weight 13 (refer to the FIG. 4). The stationary member 12 is provided with a supporting table 14 for supporting a take-up bobbin 42, a strut portion 15 (refer to the FIG. 2) for supporting a driving shaft 19 (hereinafter described) and a traverse cam shaft 32 (hereinafter described). The supporting table 14 consists of cylindrical table portion 14*a* and hollow cylindrical portion 14*b*. The hollow cylindrical portion 14*b* is provided with a yarn inserting hole 55 and supports a bobbin holder 39 through bearings 40,40 on the outer peripheral portion.

Figure 2:
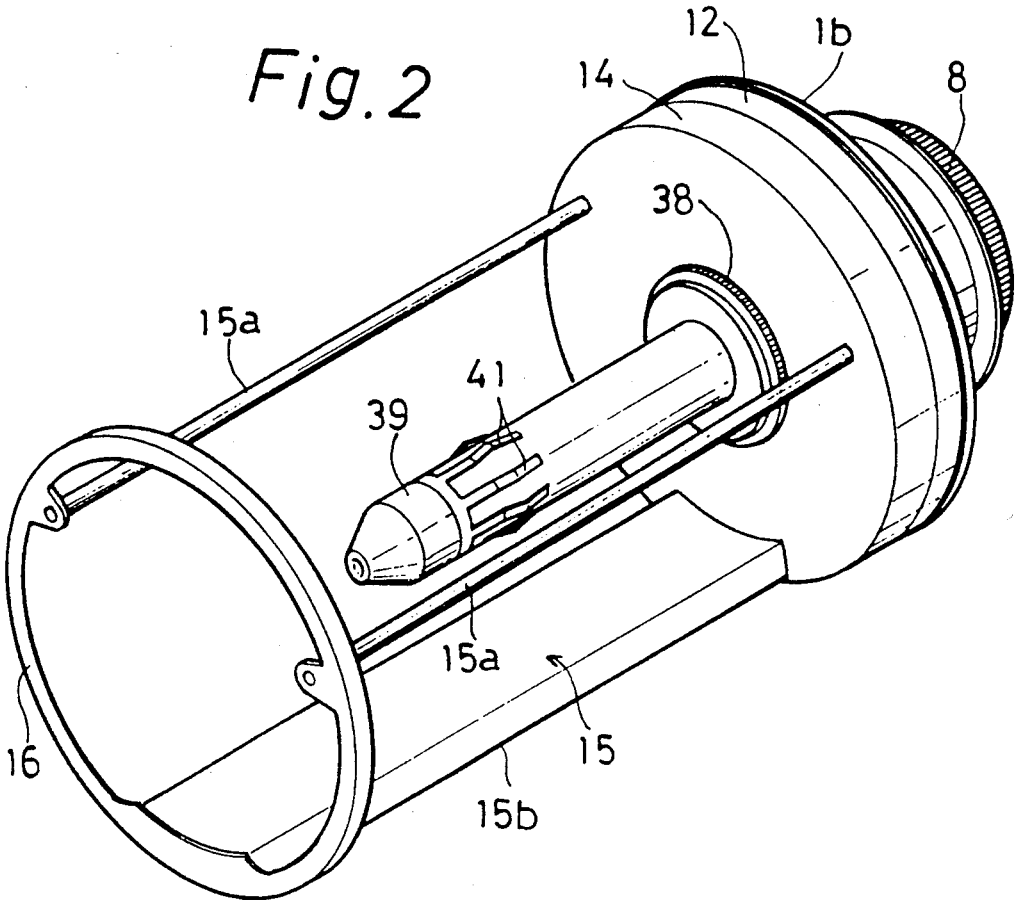
FIG. 2 is a perspective view of the double twist spindle apparatus mainly showing a rotating disc and a bobbin holder, and most of the other part is omitted.

The strut portion 15 is, as illustrated in the FIG. 2, composed of two rods 15*a*,15*a* and a channel member 15*b*. Each end of the rods 15*a*,15*a* and the channel member 15*b* are fixed to a balloon controlling ring 16. Reference numeral 17 represents a timing pulley fixed to an end of the driven wheel 10, and 18 a timing belt engaged with the timing pulley 17 on its one end, and the other end of the timing belt 18 is engaged with a timing pulley 20 mounted on one end of the driving shaft 19. The driving shaft 19 is supported by the stationary member 12 which is arranged in parallel with the hollow spindle 1. To one end of the driving shaft 19, there is attached the timing pulley 20 as described above, and to the other end of the shaft 19, a regulating roller 22 is attached through a speed-increasing gear mechanism 21 with a timing pulley 24 arranged therebetween. The regulating roller 22 is a member which utilizes skin friction as known well.

Figure 3:
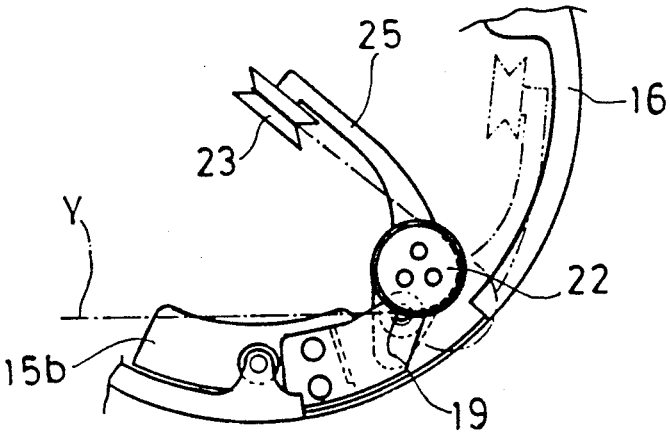
FIG. 3 is a view of main part taken in the part III—III in the FIG. 1.

A guide roller 23 is rotatably attached to an end of a top guide arm 25 which is attached to one end of the driving shaft 19 as illustrated in the FIG. 3. The guide roller 23 guides yarns to a traverse means through the regulating roller 22 after passing the hole 1*a* of the hollow spindle 1.

Figure 4:
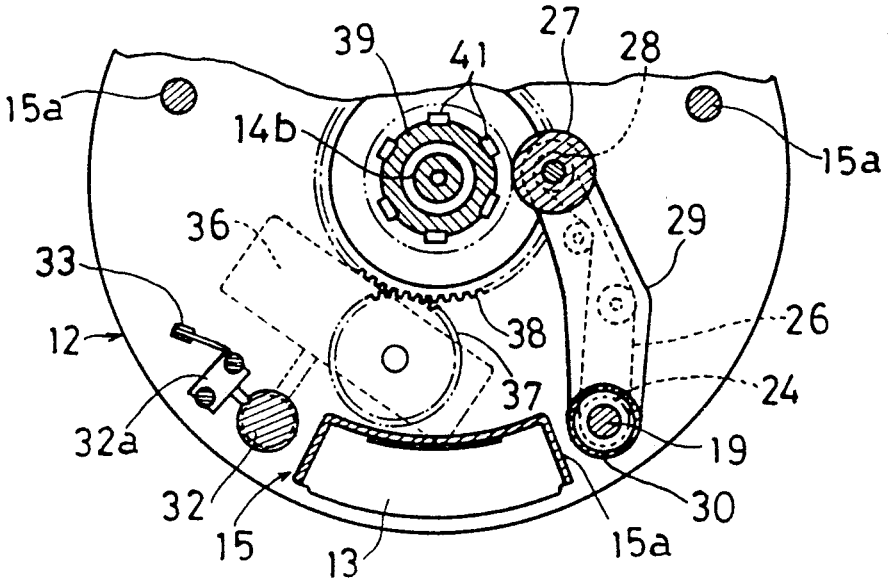
FIG. 4 is a sectional view of main part taken in the part IV—IV in the FIG. 1.
Figure 5:
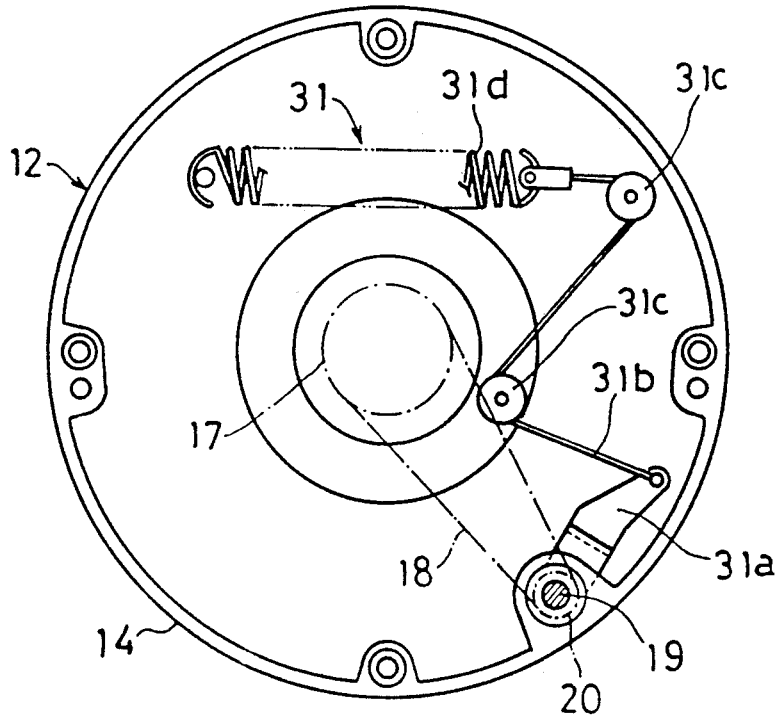
FIG. 5 is a sectional view of main part taken in the part V—V in the FIG. 1.
Figure 6:
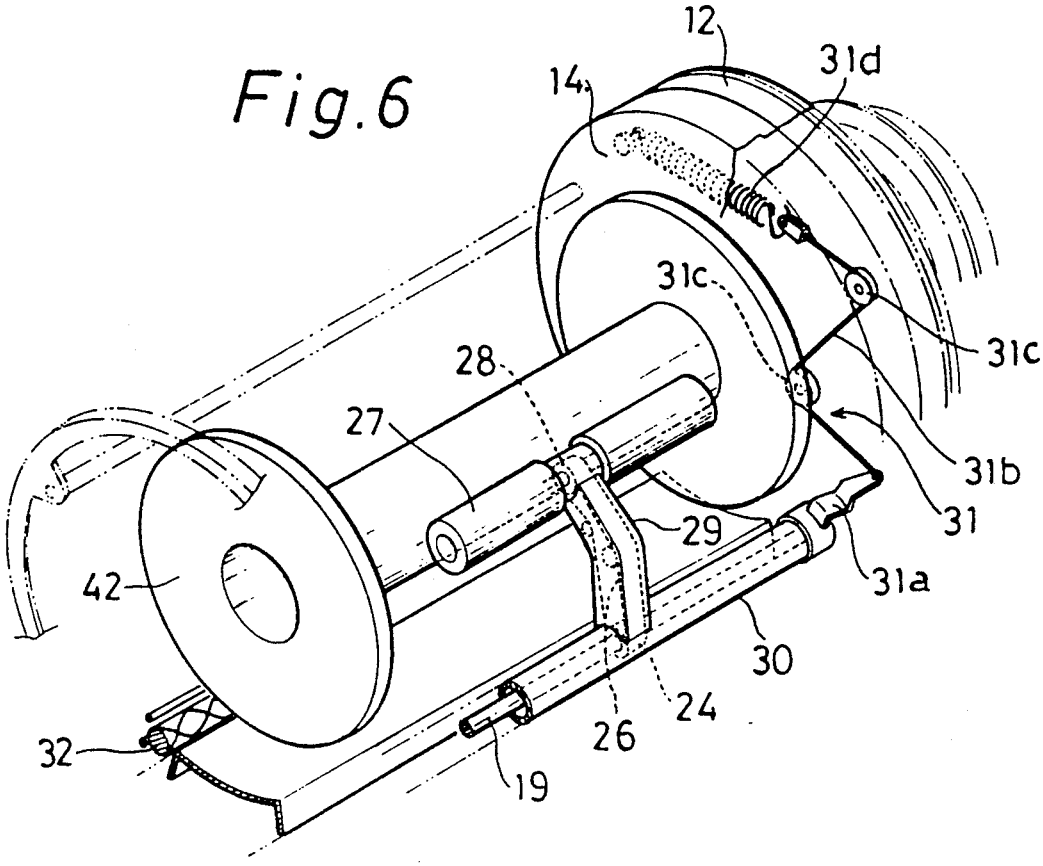
FIG. 6 is a perspective view of the double twist spindle apparatus mainly showing the relation between a driving roller and a take-up bobbin, and most of the other part is omitted.

In the FIGS. 6 and 4, reference numeral 26 represents a timing belt which is engaged on its one end with the timing pulley 24 fixed in the middle portion of the driving shaft 19. The other end of the timing belt 26 is engaged with a timing pulley 28 attached to a driving roller 27. The driving roller 27 is supported by an arm 29 which is rotatably attached to the driving shaft 19. Reference numeral 30 represents a tube mounted on the outer periphery of the driving shaft 19, and at the middle portion of the tube 30, the arm 29 to which the driving roller 27 is attached is unitarily arranged. At one end of the tube 30, there is connected pressing mechanism 31 which gives pressure between the driving roller 27 and the take-up bobbin 42. As shown in the FIGS. 5 and 6, the pressing mechanism 31 is arranged to bring the take-up bobbin 42 and the driving roller 27 come in contact with each other at a predetermined pressure since an arm 31*a* which is unitarily mounted with the tube 30 always receives rotational moving force in the counterclockwise direction by the restoring force of a spring 31*d* through a wire 31*b* and guide rollers 31*c*,31*c*.

Figure 7:
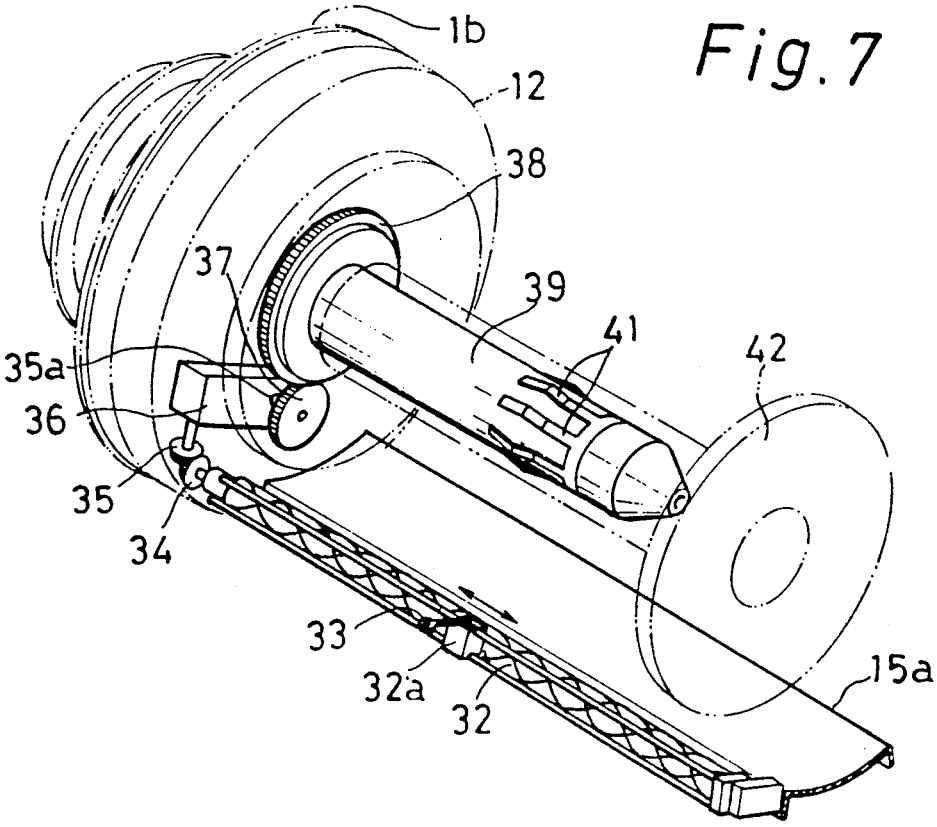
FIG. 7 is a perspective view of the double twist spindle apparatus mainly showing the relation between a traverse guide and the bobbin holder, and most of the other part is omitted.
Figure 8:
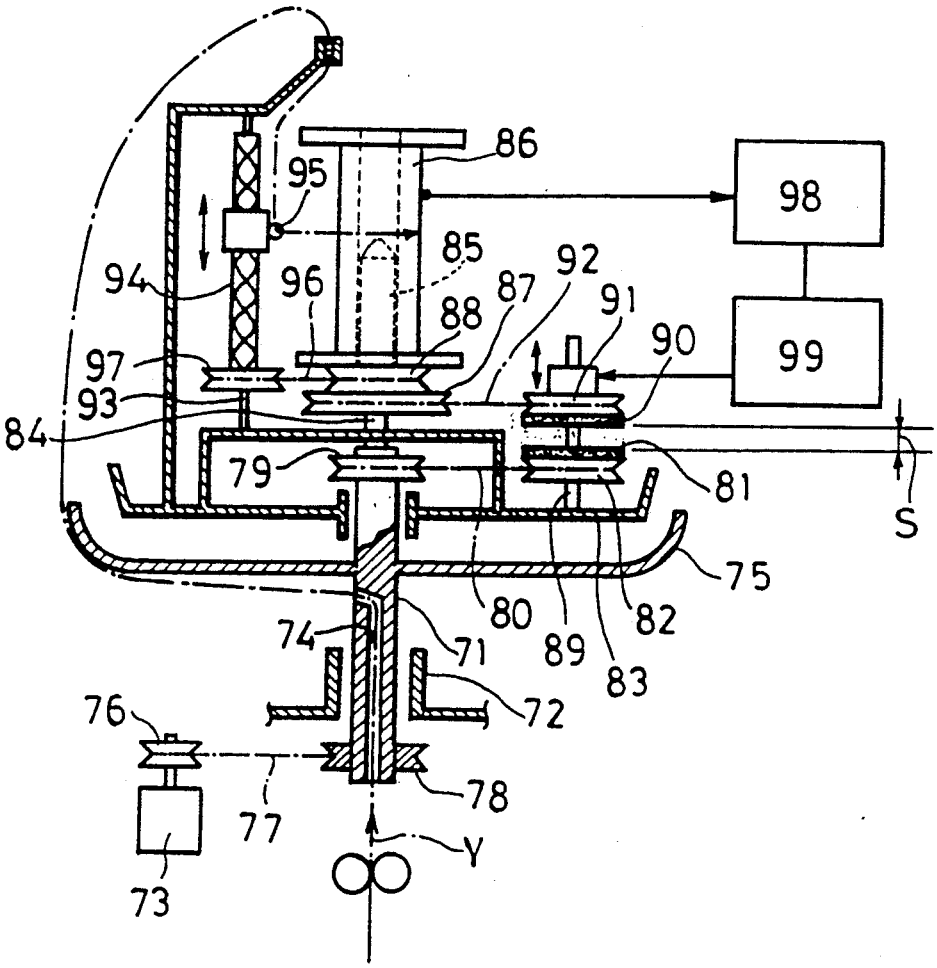
Fig. 8 PRIOR ART
FIG. 8 is a schematic illustration fundamentally showing a conventional double twist spindle apparatus.

In the FIG. 7, reference numeral 32 represents a grooved traverse cam shaft. With rotation of the traverse cam shaft 32, a moving member 32*a* performs straight reciprocating motion as shown by an arrow in the figure. Reference numeral 33 represents a traverse guide fixed to the moving member 32*a*, and 34 a bevel gear attached to the cam shaft 32. The bevel gear 34 engages with a bevel gear 35 which is connected to speed reducing mechanism 36. Reference numeral 37 represents a spur gear attached to a rotary shaft 35*a* of the speed reducing mechanism 36, and reference numeral 38 represents a spur gear which engages with the spur gear 37 and is fixed to a bobbin holder 39.

The inside of the bobbin holder 39 is formed hollow and the hollow tubular portion 14*b* of the supporting table 14 is inserted through the hollow section. The bobbin holder 39 is rotatably supported on the hollow tubular portion 14*b* through bearings 40,40 (refer to the FIG. 1). Reference numeral 41 represents a basket spring fitted on the outer periphery of the bobbin holder 39. The take-up bobbin 42 is fixed to the bobbin holder 39 when the take-up bobbin 42 is fitted into the basket spring 41.

Description will now be made on how the device described above is operated.

In the FIG. 1, the hollow spindle 1 starts rotation in the bolster 3 when the timing pulley 2 is driven by an unillustrated driving source in the machine through the timing belt 2*a*, and the rotating disc 1*b* fixed to the hollow spindle 1 is thus rotated. On the other hand, even if the hollow spindle 1 and the rotating disc 1*b* are rotated, the stationary member 12 is held at rest by its self-weight and the heavy weight 13.

The driver wheel 6 which is provided with the permanent magnet 52 is driven by a driving source in the machine through the timing belt 9 and is rotated at the outer periphery of the bolster 3. The driven wheel 10 which forms a counterpart to the driver wheel 6 with the rotating disc 1*b* therebetween and having proper gap is rotated at the outer periphery of the spindle 1 synchronously with the driver wheel 6 since it is provided with the permanent magnet 53 which is attracted by and unitarily moves with the permanent magnet 52. When the driven wheel 10 is rotated, the driving shaft 19 starts rotation through the timing belt 18 which is engaged with the timing pulley 17 attached to the driven wheel 10.

When the driving shaft 19 is rotated, the timing pulley 28 starts rotation through the timing belt 26 which is engaged with the timing pulley 24 attached to the driving shaft 19, and the driving roller 27 fixed to the timing pulley 28 starts rotation. Consequently, the take-up bobbin 42 which is normally pressed in contact with the driving roller 27 is driven by the surface frictional force. The regulating roller 22 attached to the end portion of the driving shaft 19 is also driven.

When the take-up bobbin 42 is driven, the bobbin holder 39 which fixes the take-up bobbin 42 with the basket spring 41 is driven. The spur gear 37, speed-reducing mechanism 36 and bevel gears 35,34 are thus driven by the spur gear 38 attached to the bobbin holder 39, and the traverse cam shaft 32 is driven consequently. When the traverse cam shaft 32 is rotated, the traverse guide 33 performs the straight reciprocating motion.

The first-twisted two lines of component yarns Y are arranged in order and guided to the rotating disc 1*b* through a thread eye 43 drawing ballooning. Then, the lines of yarns Y are guided to the hole 1*a* of the hollow spindle 1 swinging around the bottom outer periphery of the rotating disc 1*b* by ½ to 2 winds. The lines of yarns Y are then guided to the guide roller 23 through the yarn inserting hole 55 of the hollow tubular portion 14*b*.

The lines of yarns Y are twisted in the path running from the thread eye 43 to the guide roller 23. The lines of yarns Y passed through the guide roller 23 are drawn out by the regulating roller 22 and wound around the take-up bobbin 42 after passing through the traverse guide 33.

With the progress of the winding operation of the lines of yarns Y, when the winding diameter of the take-up bobbin 42 is increased, the driving roller 27 which is pressed in contact with the surface of the yarns wound on the take-up bobbin 42 moves outwardly in the radial. With the movement of the driving roller 27, the arm 29 is also moved outwardly. Since the arm 29 is connected to the pressing mechanism 31, the driving roller 27 always gives proper pressure to the take-up bobbin 42 and rotatively drives the bobbin 42. The driving force which is inputted from the timing belt 9 drives the driver wheel 6, driven wheel 10, driving shaft 19 and driving roller 27 successively always at a constant rotational speed since they are all rotated synchronously. Accordingly, the lines of yarns Y are wound on the bobbin 42 always at a constant winding speed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A double twist spindle apparatus, comprising:

a hollow spindle rotatably supported by a bolster fixed to the main frame of machine;

a bowl-shaped rotating disc unitarily arranged in the hollow spindle;

a stationary member supported at an end portion of the hollow spindle and being kept under non-rotation state;

hollow tubular portion unitarily arranged on the stationary member at a coaxial position with the hollow spindle in series;

a bobbin holder positioned at outer periphery of the hollow tubular portion and being rotatably supported on the hollow tubular portion;

a take-up bobbin fitted on the bobbin holder and supported thereat;

a driving roller supported by the stationary member;

pressing mechanism which always brings the driving roller in contact with outer preiphery of the take-up bobbin;

a traverse guide supported by the stationary member and performs straight reciprocating motion in the direction parallel to the take-up bobbin;

yarn inserting holes arranged in the hollow spindle and hollow tubular portion;

yarn guiding means for guiding two lines of yarns to the yarn inserting holes and traverse guide;

first driving force inputting means for rotatively driving the hollow spindle directly;

second driving force inputting means for rotatively driving the driving roller;

transmission means for transmitting driving force of the second driving force inputting means to the driving roller;

a driver wheel which is rotatively driven by the second driving force inputting means and being rotatably supported by the bolster;

a driven wheel which stands opposite to the driver wheel with the rotating disc therebetween and being rotatably supported by the hollow spindle;

magnetic transmission means for transmitting driving torque of the driver wheel to the driven wheel by magnetic attracting force;

a driving shaft supported by the stationary member and being arranged in parallel with the take-up bobbin;

transmission means for transmitting the rotation of the driven wheel to the driving shaft;

transmission means for transmitting the rotation of the driving shaft to the driving roller;

a tube rotatably fitted on the driving shaft;

an arm unitarily mounted on the tube and supporting the driving roller; and a spring means connected with the tube and energizing the tube in the direction the driving roller presses in contact with the take-up bobbin.

* * * * *